US005881462A

United States Patent [19]

Romani

[11] Patent Number: 5,881,462

[45] Date of Patent: Mar. 16, 1999

[54] CONFORMING VACUUM ATTACHMENT FOR MOUNTING TO HAIR GROOMING CLIPPERS

[75] Inventor: R. Marlene Romani, Indiana, Pa.

[73] Assignee: M.D.C. Romani, Inc., Indiana, Pa.

[21] Appl. No.: 901,942

[22] Filed: Jul. 29, 1997

[51] Int. Cl.[6] ..... B25F 3/00

[52] U.S. Cl. ..... 30/133; 30/41.5

[58] Field of Search ..... 30/133, 132, 41.5; 15/339

[56] References Cited

U.S. PATENT DOCUMENTS

| | | | |
|---|---|---|---|
| D. 337,176 | 7/1993 | Romani | D28/54 |
| 2,748,472 | 6/1956 | Sheley et al. | 30/133 |
| 3,348,308 | 10/1967 | Andis | 30/133 |
| 3,384,919 | 5/1968 | Jording et al. | 30/133 X |
| 5,088,199 | 2/1992 | Romani | 30/133 |

*Primary Examiner*—Douglas D. Watts
*Attorney, Agent, or Firm*—Michael R. Swarte; John R. Flanagan

[57] ABSTRACT

A conforming vacuum attachment includes a body defining an internal chamber, an adhesive substance for securing the body to a hair grooming clipper at a location adjacent to a set of cutting blades thereof, and a tubular member integral with the body and in communication with the internal chamber defined by the body for receiving and transporting hair clippings away from the set of cutting blades of the hair grooming clipper by means of a vacuum generated flow of air through the internal chamber. The body has a top wall, a pair of opposite side walls, a rear wall defining an opening, and a front edge on the top wall and opposite side walls. The top wall and opposite side walls of the body define the internal chamber which is closed at a rear end by the rear wall open at a front end and at a bottom such that when the body is mounted on the clipper at arcuate-shaped oppositely facing interior surfaces of the opposite side walls and a transverse rear bottom surface of the rear wall the bottom of the internal chamber is closed such that the internal chamber forms a passage for air flow from the front end thereof to the opening in the rear wall and the front edge of the body is disposed adjacent to the blades of the clipper to provide an entrance to the passage at the front end of the internal chamber. The front edge of the body also defines a recessed portion along the top wall for expansion of the passage for air flow therethrough.

20 Claims, 2 Drawing Sheets

CONFORMING VACUUM ATTACHMENT FOR MOUNTING TO HAIR GROOMING CLIPPERS

BACKGROUND OF THE INVENTION

1. Field of the Invention

The present invention generally relates to hair grooming clipper attachments and, more particularly, is concerned with a vacuum or suction attachment conformed for mounting to hair grooming clippers.

2. Description of the Prior Art

To obviate concerns of professional dog groomers with breathing of fine dog hair and other foreign matter in the lungs, vacuum systems are often employed with hair grooming clippers. Typically, a vacuum system includes a suction head that is attached to a hand-held clipper adjacent to its cutting head and is connected to one end of a flexible hose. The other end of the hose is connected directly or via an intermediate conduit to a vacuum generating unit for creating a vacuum in the hose. The vacuum condition draws air into the hose through the suction head, entraining hair cuttings in the air flow through the hose to the vacuum generating unit where the hair cuttings are collected, typically, in a container.

Attachments have been developed over the years which provide a vacuum system for the disposal of hair cuttings from hair grooming clippers. One highly effective prior art vacuum attachment is disclosed in U.S. Pat. No. 5,088,199 to Romani. While this prior art vacuum attachment introduced several features which operated to remove hair clippings in a highly effective way, it required the use of screws to fasten it to the hair grooming clipper via holes that were provided thereon for another purpose. Recent clippers do not have such holes and thus the above-cited prior art vacuum attachment cannot readily be attached to these clippers.

Consequently, a need exists for an attachment design which will conform to recent clippers while still retaining the many advantageous features of the prior art vacuum attachment.

SUMMARY OF THE INVENTION

The present invention provides a conforming vacuum attachment for hair grooming clippers which is designed to satisfy the aforementioned need. One feature of the conforming vacuum attachment of the present invention relates to the means for mounting it to the hair grooming clipper. The conforming vacuum attachment does not have screw holes nor employ screws. Instead, arcuate-shaped oppositely-facing interior side surfaces and a transverse rear bottom surface extending between and interconnecting rear ends of the interior side surfaces are provided on the attachment for conformably seating on portions of opposite rounded side edges and of a top surface of the clipper and an adhesive substance is applied therebetween to secure the conforming vacuum attachment to the hair grooming clipper. Another feature of the conforming vacuum attachment is a recessed portion which enables hair cuttings to be vacuumed over the cutting blades of the hair grooming clipper and into the conforming vacuum attachment rather than be suctioned through the cutting blades. The conforming vacuum attachment incorporates these new features while retaining the advantageous features of the prior art vacuum attachment as described in the above-cited patent.

Accordingly, the present invention is directed to a conforming vacuum attachment for a hair grooming clipper. The conforming vacuum attachment comprises: (a) a body defining an internal chamber and having portions whose shape conforms to portions of a hair grooming clipper for mounting the body to a hair grooming clipper at a forward location thereon adjacent to a set of cutting blades of the hair grooming clipper; and (b) a tubular member connected with the rear wall of the body for providing communication with the internal chamber through the opening in the rear wall for receiving and transporting hair clippings away from the set of cutting blades of the hair grooming clipper through the internal chamber by means of a vacuum condition produced in the internal chamber causing a flow of air.

The attachment body has a top wall, a pair of opposite side walls connected to and extending downward from lateral edges of the top wall, a front edge on the top wall and opposite side walls, and a rear wall defining an opening and connected to and extending downward from the top wall and between the opposite side walls. The opposite side walls define arcuate-shaped oppositely-facing interior side surfaces and the rear wall defines a transverse rear bottom surface extending between and interconnecting rear ends of the interior side surfaces for conformably seating and mounting the body upon portions of opposite rounded side edges and of a top surface of the clipper. The attachment also includes means such an adhesive substance applied between the conforming interior side and rear bottom surfaces of the body and the side edges and top surface of the clipper for securing the body to the clipper so that the front edge of the body is disposed adjacent to the set of cutting blades of the hair grooming clipper.

The top wall and opposite side walls of the body together form an inverted substantially U-shaped configuration which is closed at the rear end by the rear wall. The top wall, opposite side walls and rear wall of the body thereby define the internal chamber in the body with an open front end and an open bottom so that when the body is mounted on the clipper the bottom of the internal chamber is closed such that the internal chamber forms a passage for air flow from the front end thereof to the opening in the rear wall and the front edge of the body has a portion spaced above the clipper to provide an entrance to the passage at the front end of the internal chamber. The front edge of the body has a recessed portion along the top wall of the body increasing the size of the open front of the internal chamber for expansion of the air flow into the passage defined by the internal chamber. The recessed portion provides greater space at the passage entrance for air flow into the passage in comparison to the space for air flow provided by the passage in the absence of a recessed portion and thereby lessens the chance that hair cuttings will be drawn through the set of cutting blades of the hair grooming clipper.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
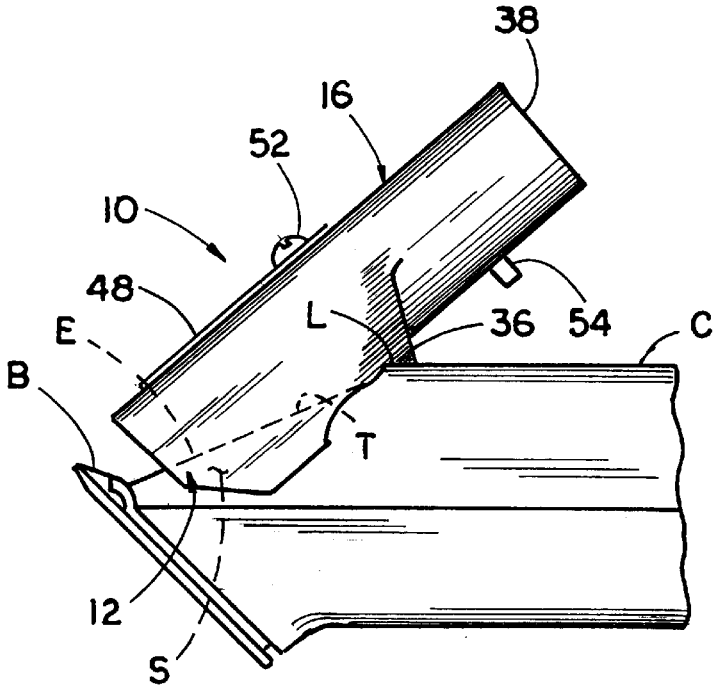
FIG. 1 is a side elevational view of a portion of a conventional hand-held hair grooming clipper and a conforming vacuum attachment of the present invention shown mounted on the hair grooming clipper.
Figure 2:
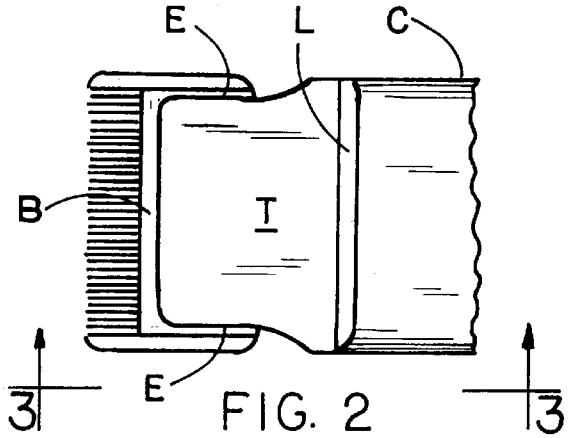
FIG. 2 is a top plan view of the portion of the hair grooming clipper shown in FIG. 1, but here shown on a reduced scale along line 2—2 of FIG. 3.
Figure 8:
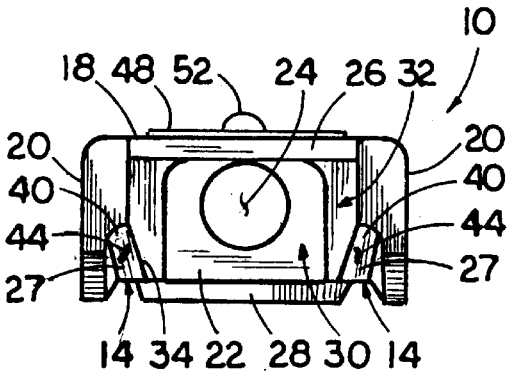
FIG. 8 is a front elevational view of the attachment as seen along line 8—8 of FIG. 4.
Figure 3:
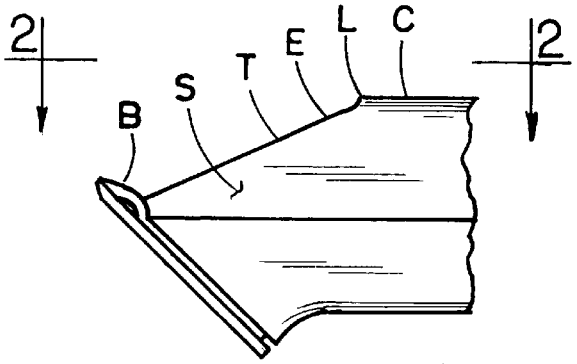
FIG. 3 is a side elevational view of the portion of the hair grooming clipper shown in FIG. 1, but here shown on a reduced scale along line 3—3 of FIG. 2.
Figure 9:
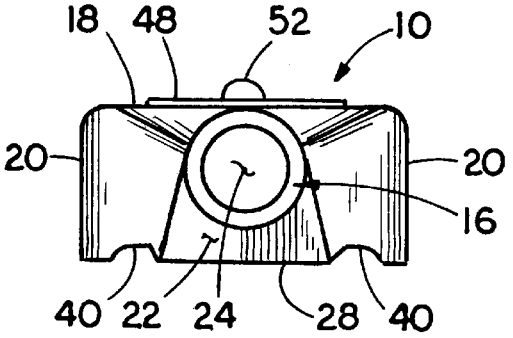
FIG. 9 is a rear elevational view of the attachment as seen along line 9—9 of FIG. 4.
Figure 4:
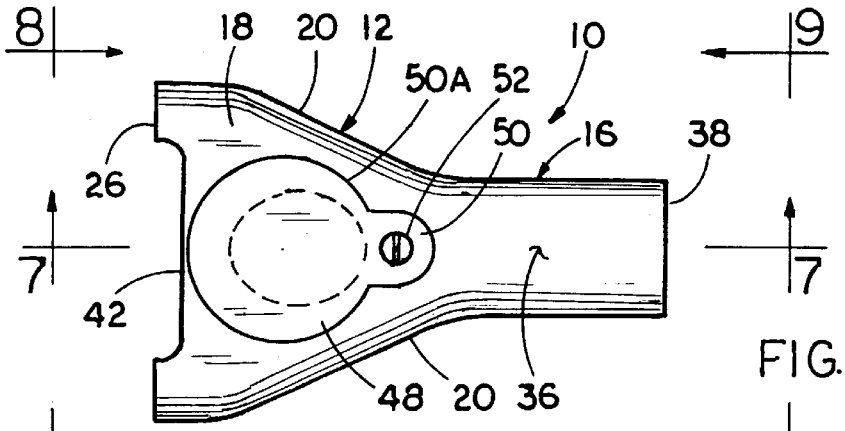
FIG. 4 is a top plan view of the conforming vacuum attachment shown in FIG. 1, but here shown dismounted from the hair grooming clipper.
Figure 5:
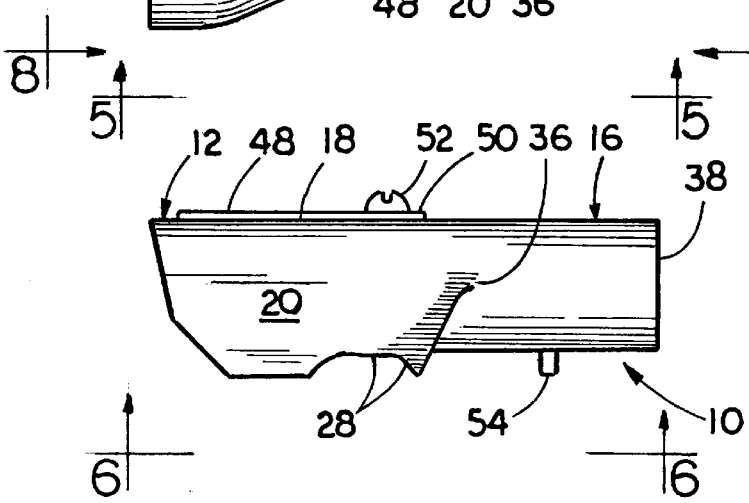
FIG. 5 is a side elevational view of the attachment as seen along line 5—5 of FIG. 4.
Figure 6:
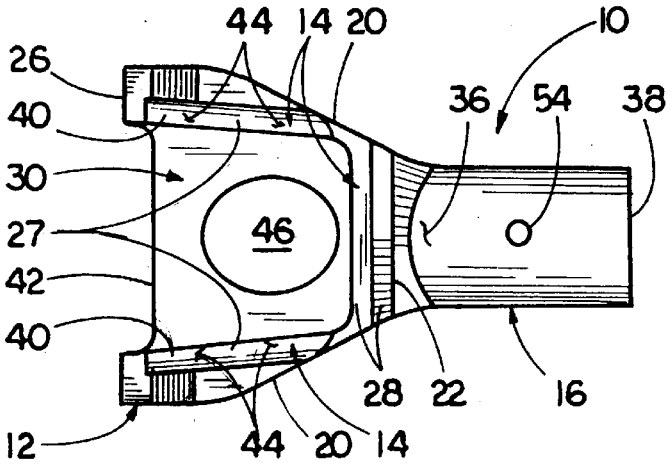
FIG. 6 is a bottom plan view of the attachment as seen along line 6—6 of FIG. 5.
Figure 7:
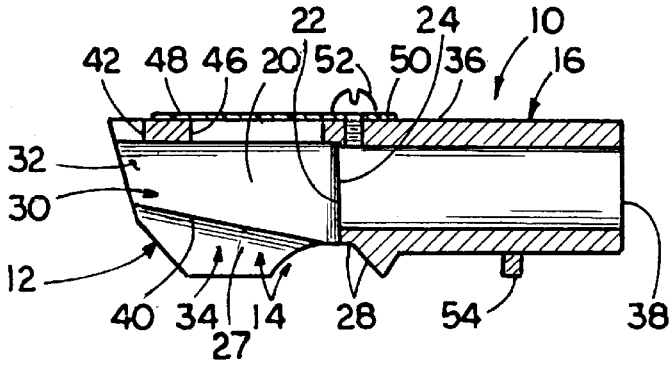
FIG. 7 is a longitudinal sectional view of the attachment as seen along line 7—7 of FIG. 4.

Referring to the drawings, and particularly to FIGS. 1 and 4 to 9, there is illustrated a conforming vacuum attachment, generally designated 10, of the present invention for mounting on the hair grooming clipper C of FIGS. 1 to 3. Basically, the conforming vacuum attachment 10 includes a body 12 having a conforming surface portion 14 for seatably mounting the body 12 onto the clipper C at a forward location thereon rearwardly of and adjacent to a set of cutting blades B of the clipper C, and a rear tubular member 16 attached to the body 12.

More particularly, the attachment body 12 has a top wall 18, a pair of opposite side walls 20 connected to and extending downward from lateral edges of the top wall 18, a rear wall 22 defining an opening 24 and connected to and extending downward from the top wall 18 and between the opposite side walls 20. The body 12 also has a front edge 26 on the top wall 18 and opposite side walls 20. The opposite side walls 20 define arcuate-shaped oppositely-facing interior side surfaces 27 and the rear wall 22 defines a transverse rear bottom surface 28 extending between and interconnecting rear ends of the interior side surfaces 27 for providing the portion 14 of the body 12 that conformably seats and mounts onto portions of opposite rounded side edges E and of a top surface T of the clipper C. The top wall 18 and opposite side walls 20 of the body 12 together form an inverted substantially U-shaped configuration which is closed at the rear end by the rear wall 22. The top wall 18, opposite side walls 20 and rear wall 22 thereby define an internal chamber 30 in the body 12 being open at a front end 32 and at a bottom 34 thereof so that when the body 12 is mounted on the clipper C the bottom 34 of the internal chamber 30 is closed such that the internal chamber 30 forms a passage for air flow from the front end 32 thereof to the opening 24 in the rear wall 22 and the front edge 26 of the body 12 has a portion spaced above the clipper C to provide an entrance to the passage at the front 32 of the internal chamber 30 disposed adjacent to the cutting blades B of the clipper C.

The tubular member 16 of the attachment 10 has opposite first and second ends 36, 38 and is provided in communication with the internal chamber 30 of the body 12 via the opening 24 defined by the rear wall 22 of the body 12. The first end 36 of the tubular conduit 16 is integrally connected with the rear wall 22 of the body 12. The second end 38 of the tubular conduit 12 is available for connection to any suitable external hose (not shown) leading to and connected to a vacuum generating unit (not shown) for creating a vacuum condition that will cause a flow of air over the set of cutting blades B of the hair grooming clipper C for the collection and transport of hair cuttings away therefrom and through the passage defined by the internal chamber 30 of the body and therefrom into and through the tubular conduit 16 to and through the external hose. The body 12 and tubular conduit 16 are both preferably comprised of a substantially rigid metal material, but may be made of any other suitable material.

Referring now to FIGS. 1 to 9, the top wall 18 of the body 12 has a substantially trapezoidal shape with a front base of the trapezoidal shape disposed rearwardly from the front edge 26 of the body 12 and a rear base of the trapezoidal shape disposed at the rear wall 22 of the body 12. As mentioned above, the rear wall 22 of the body 12 extends transversely between and interconnects the opposite side walls 20 of the body 12 and the top wall 18 and the opposite side walls 20 of the body 12 form an inverted substantially U-shaped configuration, but may form any other suitable configuration. The arcuate-shaped oppositely-facing interior surfaces 27 of the opposite side walls 20 form longitudinal interior ledges 40 which are recessed therein and have a concave shape in cross-section which contact opposite side edges E of the hair grooming clipper C and thereby permit the top surface T of the hair grooming clipper C to extend across and close the bottom 34 of the internal chamber 30 defined by the body 12. The opposite side walls 20 of the body 12 extend downwardly beyond the opposite side edges E of the hair grooming clipper C and terminate along opposite sides S of the hair grooming clipper C. The transverse rear bottom surface 28 on the rear wall 22 of the body 12 is contoured so as to substantially conform to the top surface T of the hair grooming clipper C. In the illustrated embodiment, the bottom surface 28 has a step-like configuration to conform to a transverse lip L defined on the clipper C.

The front edge 26 of the body 12 defines a recessed portion 42 along the top wall 18 of the body 12 which increases the size of the open front 32 of the internal chamber 30 for expansion of the air flow through the passage defined by the internal chamber 30. The recessed portion 42 defined by the front edge 26 of the body 12 thus provides greater space for air flow through the passage in comparison to the space for air flow provided by the passage in the absence of a recessed portion 42 and thereby lessens the chance that hair cuttings will pass back through the set of cutting blades B of the hair grooming clipper C. The passage defined by the internal chamber 30 between the body 12 and clipper top surface T is substantially greater in cross-sectional area than the opening 24 defined by the rear wall 22 of the body 12. Hair cuttings will be entrained in the air flow passing through the internal chamber 30 defined by the body 12 and through the opening 24 defined by the rear wall 22 of the body 12 and into the tubular conduit 16 and into the external hose and to the vacuum generating unit. The hair cuttings will be deposited from the external hose into any suitable container (not shown).

The attachment 10 further includes an adhesive substance 44 applied to the opposing interior surfaces 27 and transverse rear bottom surface 28 defined respectively by the opposite side walls 20 and rear wall 22 of the body 12 and to the portions of the opposite side edges E and top surface T of the hair grooming clipper C for fixedly securing the body 12 onto the hair grooming clipper C so that the front edge 26 of the body 12 is disposed adjacent to the set of cutting blades B of the hair grooming clipper C. Effective functioning of the adhesive substance relies upon accurate and close conformity between the respective surface portions of the body 12 of the attachment 10 and of the hair grooming clipper C which make contact with one another. The adhesive substance may be of any suitable type.

For performing different lengths and styles of hair cuts on pets, it is desirable to be able to easily and frequently vary the amount of vacuum applied through the internal chamber 30 defined by the body 12. Regulation of the vacuum condition can be accomplished by a vacuum relief port 46 defined in the top wall 18 of the body 12. The vacuum relief port 46 is in the form of a circular hole, but may have other suitable configurations. The vacuum relief port 46 is disposed intermediate between the front edge 26 and the rear wall 22 of the body 12 and is for providing communication between the internal chamber 30 defined by the body 12 and an external environment. The attachment 10 further includes a closure 48 in the form of a flexible sealing lid mounted to the top wall 18 of the body 12 and overlying the vacuum relief port 46. The closure 48 has a circular disc-like shape, but may have any other suitable shape, and is attached to the top wall 18 of the body 12 only at a peripheral tab 50 protruding from one location on its peripheral edge 50A by a fastener 52 adjacent to the vacuum relief port 46. The closure 48 has a diameter greater than that of the vacuum relief port 46. The closure 48 is movable in order to vary the amount of area of the vacuum relief port 46 closed by the closure 48 and thereby regulates the degree of relief through the vacuum relief port 46 of the vacuum condition within the internal chamber 30 defined by the body 12.

The tubular conduit 16 has a nipple 54 formed on and protruding outwardly from an exterior surface 56 thereof. The nipple 54 is disposed intermediate between the first and second ends 36, 38 of the tubular conduit 16, but may be disposed in any other suitable location. The nipple 54 is for securable insertion into a notch (not shown) defined by the external hose so as to couple the tubular conduit 16 to the external hose. The tubular conduit 16 has an internal diameter of substantially the same size as the cross-sectional area of the opening 24 defined by the rear wall 22 of the body 12, but may have any other suitable size. The tubular conduit 16 preferably has a length substantially similar to a longitudinal length of the body 12, but may have any other suitable length in relation thereto.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A conforming vacuum attachment for use with a hair grooming clipper, said attachment comprising:

(a) a body having a top wall, a pair of opposite side walls connected to and extending downward from lateral edges of said top wall, a rear wall defining an opening and connected to and extending downward from said top wall and between said opposite side walls, and a front edge on said top wall and opposite side walls, said opposite sidewalls defining arcuate-shaped oppositely-facing interior side surfaces and said rear wall defining a transverse rear bottom surface extending between and interconnecting rear ends of said interior side surfaces for conformably seating and mounting said body upon portions of opposite rounded side edges and of a top surface of a hair grooming clipper, said top wall and opposite side walls defining an internal chamber closed at a rear end thereof by said rear wall and open at a front end and a bottom thereof so that when said body is mounted on the hair grooming clipper said internal chamber provides a passage for air flow and said front edge of said body is disposed adjacent to front cutting blades of the clipper to provide an entrance to said passage at said front end of said internal chamber adjacent to the cutting blades of the clipper, said oppositely facing interior side surfaces on said opposite side walls of said body defining rounded ledges thereon recessed into said interior side surfaces which are concave shape in cross-section for receiving the opposite side edges of the top wall of the hair grooming clippers between said opposite side walls of said body; and (b) a tubular member connected to said body for providing communication with said internal chamber defined by said body via said opening of said rear wall, said tubular member having a first end connected with said rear wall of said body and a second end available for connection to an external hose leading to and connected to a vacuum generating unit for creating a vacuum condition causing flow of air over the cutting blades of the hair grooming clipper for the collection and transport of hair cuttings away therefrom and through said internal chamber and said tubular member.

2. The attachment as recited in claim 1, further comprising:

means for securing said body along said oppositely facing interior side surfaces of said opposite side walls and said transverse rear bottom surface of said rear wall thereof to the hair grooming clipper.

3. The attachment of claim 2, wherein said securing means is an adhesive substance applied to said oppositely facing interior side surfaces of said opposite side walls and said transverse rear bottom surface of said rear wall of said body and to the opposite side edges and top surface of the hair grooming clipper for securing said body to the hair grooming clipper so that said front edge of said body is disposed adjacent to the set of cutting blades of the hair grooming clipper.

4. A conforming vacuum attachment for use with a hair grooming clipper, said attachment comprising:

(a) body having a top wall, a pair of opposite side walls connected to and extending downward from lateral edges of said top wall, a rearwall defining an opening and connected to and extending downward from said top wall and between said opposite side walls, and a front edge on said top wall and opposite side walls, said opposite sidewalls defining arcuate-shaped oppositely-facing interior side surfaces and said rear wall defining a transverse rear bottom surface extending between and interconnecting rear ends of said interior side surfaces for conformably seating and mounting said body upon portions of opposite rounded side edges and of a top surface of a hair grooming clipper, said top wall and opposite side walls defining an internal chamber closed at a rear end thereof by said rear wall and open at a front end and a bottom thereof so that when said body is mounted on the hair grooming clipper said internal chamber provides a passage for air flow and said front edge of said body is disposed adjacent to front cutting blades of the clipper to provide an entrance to said passage at said front end of said internal chamber adjacent to the cutting blades of the clipper, said top wall of said body defining a recessed portion along said top wall for increasing the size of said entrance to said passage defined by said internal chamber for expansion of air flow therethrough; and (b) a tubular member connected to said body for providing communication with said internal chamber defined by said body via said opening of said rear wall, said tubular member having a first end connected with said rear wall of said body and a second end available for connection to an external hose leading to and connected to a vacuum generating unit for creating a vacuum condition causing flow of air over the cutting blades of the hair grooming clipper for the collection and transport of hair cuttings away therefrom and through said internal chamber and said tubular member.

5. The attachment of claim 1, wherein said top wall and said pair of opposite side walls of said body form an inverted substantially U-shaped configuration.

6. The attachment of claim 1, wherein said top wall of said body has a substantially trapezoidal shape with a front base of said trapezoidal shape disposed rearwardly from said front edge of said body and a rear base of said trapezoidal shape disposed at said rear wall of said body.

7. The attachment of claim 1, wherein said pair of opposite side walls of said body extend downwardly beyond the opposite side edges of the hair grooming clipper and terminate on opposite sides of the hair grooming clipper.

8. The attachment of claim 1, wherein said transverse rear bottom surface of said rear wall of said body is contoured so as to substantially conform to the top surface of the hair grooming clipper.

9. The attachment of claim 1, wherein said top wall of said body defines a vacuum relief port intermediate between said front edge and said rear wall of said body for providing communication between said internal chamber defined by said body and an external environment.

10. The attachment of claim 9, further comprising:

a closure in the form of a flexible sealing lid mounted to said top wall of said body and overlying said vacuum relief port defined by said top wall of said body and being movable for varying the amount of area of said vacuum relief port closed by said closure and thereby regulating the degree of relief through said vacuum relief port of a vacuum condition within said internal chamber defined by said body.

11. A conforming vacuum attachment for use with a hair grooming clipper, said attachment comprising:

(a) a body having a top wall, a pair of opposite side walls connected to and extending downward from lateral edges of said top wall, a rearwall defining an opening and connected to and extending downward from said top wall and between said opposite side walls, and a front edge on said top wall and opposite side walls, said opposite side walls defining arcuate-shaped oppositely-facing interior side surfaces and said rear wall defining a transverse rear bottom surface extending between and interconnecting rear ends of said interior side surfaces for conformably seating and mounting said body upon portions of opposite rounded side edges and of a top surface of a hair grooming clipper, said top wall and opposite side walls defining an internal chamber closed at a rear end thereof by said rear wall and open at a front end and a bottom thereof so that when said body is mounted on the hair grooming clipper said internal chamber provides a passage for air flow and said front edge of said body is disposed adjacent to front cutting blades of the clipper to provide an entrance to said passage at said front end of said internal chamber adjacent to the cutting blades of the clipper, said oppositely facing interior side surfaces on said opposite side walls of said body defining rounded ledges thereon recessed into said interior side surfaces which are concave shape in cross-section for receiving the opposite side edges of the top wall of the hair grooming clippers between said opposite side walls of said body;

(b) an adhesive substance applied to said oppositely facing interior side surfaces on said opposite side walls of said body on and below said interior ledges formed thereby and to the opposite side edges of and to portions adjacent thereto of the hair grooming clipper for securing said body to the hair grooming clipper so that said front edge of said body is disposed adjacent to a set of cutting blades of the hair grooming clipper; and (c) a tubular member provided in communication with said passage defined by said internal chamber of said body via said opening of said rear wall of said body, said tubular body having a first end connected with said rear wall of said body and a second end available for connection to an external hose leading to and connected to a vacuum generating unit for creating a vacuum condition causing flow of air over the cutting blades of the hair grooming clipper for the collection and transport of hair cuttings away therefrom and through said internal chamber and said tubular conduit to the external hose.

12. The attachment of claim 11, wherein said top wall of said body defines a vacuum relief port intermediate between said front edge and said rear wall of said body for providing communication between said internal chamber defined by said body and an external environment.

13. The attachment of claim 12, further comprising:

a closure in the form of a flexible sealing lid mounted to said top wall of said body and overlying said vacuum relief port defined by said top wall of said body and being movable for varying the amount of area of said vacuum relief port closed by said closure and thereby regulating the degree of relief through said vacuum relief port of a vacuum condition within said internal chamber defined by said body.

14. The attachment of claim 11, wherein said top wall and said pair of opposite side walls of said body form an inverted substantially U-shaped configuration.

15. The attachment of claim 11, wherein said top wall of said body has a substantially trapezoidal shape with a front base of said trapezoidal shape disposed rearwardly from said front edge of said body and a rear base of said trapezoidal shape disposed at said rear wall of said body.

16. The attachment of claim 11, wherein said front edge of said body defines a recessed portion along said top wall of said body for increasing the size of said entrance to said passage defined by said internal chamber for expansion of air flow therethrough.

17. The attachment of claim 11, wherein said transverse rear bottom surface of said rear wall of said body is contoured so as to substantially conform to the top surface of the hair grooming clipper.

18. The attachment of claim 11, wherein said pair of opposite side walls of said body extend downwardly beyond the opposite side edges of the hair grooming clipper and terminate on opposite sides of the hair grooming clipper.

19. The attachment of claim 4, wherein:

said pair of opposite side walls of said body extend downwardly beyond the opposite side edges of the hair grooming clipper and terminate on opposite sides of the hair grooming clipper; and said transverse rear bottom surface of said rear wall of said body is contoured so as to substantially conform to the top surface of the hair grooming clipper.

20. The attachment of claim 4, wherein said top wall of said body defines a vacuum relief port intermediate between said front edge and said rear wall of said body for providing communication between said internal chamber defined by said body and an external environment.

* * * * *